United States Patent [19]

Rausing

[11] 3,952,900

[45] Apr. 27, 1976

[54] PACKING CONTAINER INTENDED IN PARTICULAR FOR PRESSURIZED CONTENTS

[76] Inventor: Ruben A. Rausing, Via Kenia 22-24, Rome, Italy

[22] Filed: Dec. 6, 1974

[21] Appl. No.: 530,427

[30] Foreign Application Priority Data

Dec. 17, 1973 Switzerland ..... 17631/73

[52] U.S. Cl. ..... 215/232; 215/255; 220/270; 220/359

[51] Int. Cl.[2] ..... B65D 41/48; B65D 53/00

[58] Field of Search ..... 220/270, 308, 310, 359, 220/228; 215/232, 233

[56] References Cited

UNITED STATES PATENTS

| | | | |
|---|---|---|---|
| 333,715 | 1/1886 | Ashby | 215/233 |
| 817,705 | 4/1906 | Gordon | 215/233 |
| 978,109 | 12/1910 | Blumenthal | 215/233 |
| 1,359,351 | 11/1920 | Gash | 215/233 |
| 3,172,557 | 3/1965 | Koenig | 220/270 |
| 3,303,958 | 2/1967 | Taylor | 220/270 |
| 3,731,835 | 5/1973 | Hawkins | 220/359 X |
| 3,825,148 | 7/1974 | Hunter | 220/359 |

*Primary Examiner*—Donald F. Norton
*Attorney, Agent, or Firm*—Pierce, Scheffler & Parker

[57] ABSTRACT

A cap type structure for closing a pour-out opening in the top of a packing container wherein the pour-out opening terminates in an outwardly turned flange portion which engages and interlocks with an inwardly turned flange portion on the cap which is made of plastic material and a sealing ring of thermo-plastic material is located between the inter-engaging flange portions. The cap is removed by means of a pull tab which is secured to the flange portion of the cap which causes the flange to be torn off.

3 Claims, 3 Drawing Figures

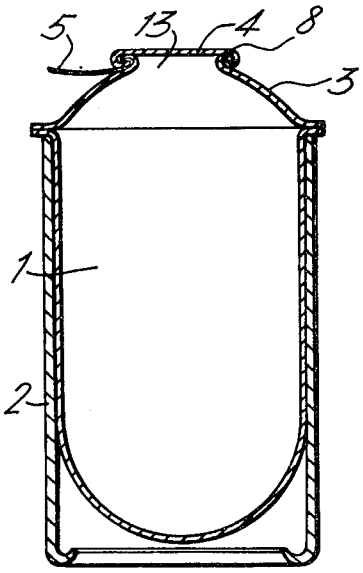
FIG.1.
FIG.2.
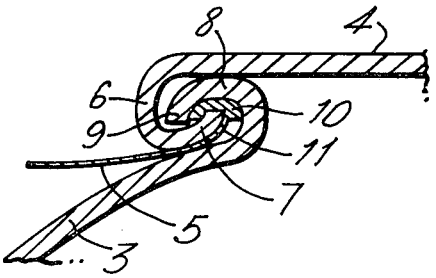
FIG.3.
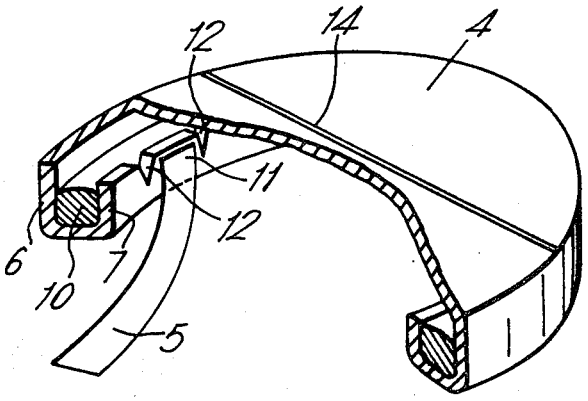

PACKING CONTAINER INTENDED IN PARTICULAR FOR PRESSURIZED CONTENTS

The present invention relates to a packing container intended in particular for pressurized contents, comprising a pouring opening which is defined by a flange bent outwards from the pouring opening and a sealing cap which tightly covers the pouring opening.

In recent years a number of packing containers for pressurized contents, e.g. refreshing drinks, beer and the like have been manufactured of plastic material and since almost all these new packing containers were of a disposable character, it was necessary from a point of view of economy to keep the amount of plastic material as low as possible, which is also of interest environmentally and in view of distribution, as the packing containers, among other things, become lighter.

One problem which proved difficult to solve in these new packing containers was to design a tight and yet easily openable cap. It is known that the pouring openings of the kind of container referred to here can be sealed with the help of different types of plastic stoppers with sealing tabs which are in contact with the inside of the pouring opening, and it is also known that cover disks can be sealed firmly over the pouring opening. The firmly sealed cover disks certainly have the prerequisites to remain tight, but they are difficult to remove when the package is to be opened, and they have therefore not come into general use. On the other hand, the different forms of stoppers which can be introduced into the pouring opening will certainly be relatively easily openable, but it will be difficult to make these cap arrangements gas-tight. It was found that the packing containers in accordance with the present invention are relatively easily openable and at the same time show satisfactory gas-tightness. The invention is characterized in that the outer portion of the said outwards-bent flange is turned down to form an annular rim, which together with the rest of the flange defines an annular space, that the said annular space contains a sealing compound and that the edge zone of the cap has a turned-down portion, the outer edge of which is turned over in such a manner that it is directed substantially towards the underside of the cap, the turned-over edge zone of the cap being adapted so as to embrace the folded-down portion of the said flange by means of a hook engagement, and that the said outer edge of the cap is introduced into the said annular space, and, along the whole of its circumference, is brought into contact with the said sealing compound.

In the following an embodiment of the invention will be described with reference to the enclosed schematic drawing, in which FIG. 1 shows a cross-section of a packing container intended for pressurized contents, FIG. 2 shows a greatly enlarged cross-section of the opening area of the packing container in accordance with FIG. 1, and FIG. 3 shows a cut-away perspective picture of a cap arrangement for the packing container.

The packing container shown in FIG. 1 is intended to illustrate a possible embodiment of the packing containers which can be provided with the sealing arrangement in accordance with the invention, and this packing container consists of a thin inner plastic lining 1 which is surrounded by a rigid outer shell 2. The bottom part and the top part of the plastic lining are shaped in such a manner that they are subjected to substantially uniform streams in all directions, which means that no appreciable deformation of these parts takes place, whilst on the other hand the central cylindrical part has to be supported by an outer shell 2 so that it is not deformed. The packing container is provided with a pouring opening 13, which is surrounded by a flange 8 bent outwards from the pouring opening, and the pouring opening is sealed by a cap 4, which can be torn off with the help of a pull strip 5 accessible from the outside of the package. In FIG. 1 the opening arrangement in accordance with the invention is adapted to a packing container current at present commercially in the trade, but the opening arrangement may also be used in connection with other types of packing containers.

In FIG. 2, which shows a greatly enlarged cross-section of a part of the opening area in accordance with FIG. 1, parts of the top portion 3 of the packing container are illustrated, whose upper part, which defines the pouring hole 13, is bent outwards as a flange 8 from the opening hole 13, the edge portion 9 of the flange 8 being further folded down to form an annular part, whose axis is parallel with the longitudinal axis of the packing container. The flange 8, 9 (FIG. 2) shaped in this manner, forms an annular space which is filled wholly or partially with a sealing compound 10. Also as shown in FIG. 3, the annular space formed by flange portions 6 and 7 of the cap 4 may be filled with the sealing compound. This sealing compound may consist of an elastic material, so-called 'compound', but is preferably constituted of a thermoplastic material consisting of mixtures of plastics and waxes which have a relatively low melting point, but which at normal room temperature are in solid form. This sealing compound, so-called 'hot-melt', has good adhesive properties which may be activated by heating the material, but the material has a rupture strength which is less than the rupture strength of normal plastic material, e.g. polyethylene or polyvinyl chloride. The cap 4, which covers the pouring opening 13, is provided in its outer part with a turned-down flange 6, whose extreme edge is turned over to form a part 7 which is directed towards the underside of the cap 4. Since the cap is manufactured of an elastic material, e.g. polyvinyl chloride or polyethylene or some similar thermoplastic material, it is possible to deform it to such an extent that the flange portion 6, 7 of the cap can be forced over the flange portion 8,9 forming the pouring opening of the package, so that the flange 7 of the cap will be located inside the flange 9 of the pouring opening, the cap being connected in a hook-like manner with the opening portion of the packing container. When the parts of the cap 4 have been made to assume the position as shown in FIG. 2, heat is applied to the sealing compound 10, which may be done by applying heat from outside to the top part of the cap 4 by means of a heating element. The temperature of this heating element is adapted so that it is lower than the melting point of the plastic material of the cap 4 and the plastic portion 3 of the packing container, but sufficiently high for the sealing compound 10 to be made to soften or melt, whereby the flange parts 7 of the cap 4 are effectively embedded in the sealing compound so that the required gas-tightness is achieved. Also the flange portion 9 may be embedded in the sealing compound when disposed as shown in FIG. 3.

To make possible the tearing off of the cap when access is required to the contents of the packing container for consumption, the cap has been provided, in the manner shown in FIG. 3, with slots 12 in the flange part 7. In between the slots 12 a pull tab 5 of plastic material is welded to the flange 7 within the area 11. The slots 12, which normally would constitute a great hazard of gas leakage, will, on putting on of the cap, become wholly filled with sealing compound, which after cooling will solidify and thus form a weakening of the flange 7 without at the same time affecting the gas-tightness. As illustrated in FIG. 2, the pull tab 5 is accessible from the outside of the packing container after the cap has been applied over the pouring opening in the manner described above. When the packing container is to be opened, the pull tab 5 is gripped between the fingers and pulled outwards/downwards, causing the portion of the flange 7 between the slots 12 to be torn off since the sealing compound which fills the slots 12 has a smaller rupture strength than the plastic material in the cap 4. A continued, upwards directed pulling on the pull tab 5 has the effect that the tornup part of the flange 7 will be forced backwards past the flange 9 of the pouring opening, and since the continuation of the slots 12 may consist of scores or weakening lines 14 present in the cap part 4, which affect the mechanical strength of the cap but not its tightness, the cap 4 may, by continued pulling on the pull tab 5, be split up in the middle along line 14, whereupon it can readily be removed from the pouring opening.

It was found that with a pouring opening in accordance with the invention very good gas-tightness properties can be obtained whilst at the same time the cap part can relatively easily be removed.

I claim:

1. A packing container for pressurized contents comprising a container body provided with a pouring opening having an outwardly and downwardly turned peripheral flange, a sealing cap provided with a downwardly, inwardly and upwardly turned peripheral flange for interlockingly engaging the outwardly and downwardly turned flange of said container body, a sealing compound disposed circumferentially between the interlocking flanges to seal the circumferential edge of one of said flanges with the other flange, the edge of the upwardly turned portion of the flange of the sealing cap being provided with at least one slot, and a tear strip secured to the upwardly turned portion of the flange of the sealing cap adjacent said at least one slot, said tear strip extending to the outside of the package container for easy access to tear off said sealing cap.

2. A package container as claimed in claim 1 wherein two spaced slots are provided and said tear strip is secured between said slots to the upwardly turned portion of the flange of said sealing cap.

3. A package container as claimed in claim 1 wherein said sealing cap is provided with a score line extending transversely across said cap, one end of said score line extending to the at least one slot, to facilitate tearing off the sealing cap.

* * * * *